US008735789B1

(12) United States Patent
Malejko et al.

(10) Patent No.: US 8,735,789 B1
(45) Date of Patent: May 27, 2014

(54) EXTENDABLE STABILIZER FOR PROJECTILE

(75) Inventors: Gregory Malejko, Hackettstown, NJ (US); Keith Fulton, Stroudsburg, PA (US); Ductri Nguyen, Parsippany, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 716 days.

(21) Appl. No.: 12/885,712

(22) Filed: Sep. 20, 2010

(51) Int. Cl.
*F42B 15/01* (2006.01)

(52) U.S. Cl.
USPC ..... 244/3.24

(58) Field of Classification Search
USPC ..... 244/3.21, 3.24, 3.25, 3.3, 49, 139
See application file for complete search history.

(56) References Cited

U.S. PATENT DOCUMENTS 412,670 A * 10/1889 Ross ..... 102/376
656,933 A * 8/1900 Brown ..... 244/3.3
1,417,460 A * 5/1922 Driggs, Jr. ..... 102/439
3,007,410 A * 11/1961 Blacker ..... 102/380
3,256,816 A * 6/1966 Pilcher, II ..... 102/374
3,292,879 A * 12/1966 Seward ..... 244/3.3
3,738,219 A * 6/1973 Febres ..... 89/1.703
4,944,226 A * 7/1990 Wedertz et al. ..... 102/476
5,762,291 A * 6/1998 Hollis et al. ..... 244/3.24
5,892,217 A * 4/1999 Pollin ..... 244/3.3
6,492,632 B1 * 12/2002 Pollin ..... 244/3.3
6,640,720 B1 * 11/2003 Biserød ..... 102/377
6,843,179 B2 * 1/2005 Hunn et al. ..... 102/519
7,036,434 B1 * 5/2006 Vo et al. ..... 102/522
7,681,503 B1 * 3/2010 Fridley et al. ..... 102/385
7,854,410 B2 * 12/2010 Fanucci et al. ..... 244/49

* cited by examiner

*Primary Examiner* — Valentina Xavier
(74) *Attorney, Agent, or Firm* — Michael C. Sachs

(57) ABSTRACT

A statically stabilized projectile may include a fixed tail boom that may be disposed in the through-bore of a sliding tail boom. The sliding tail boom may translate or extend rearward with respect to the fixed tail boom before the projectile exits a launch tube. The through-bore of the sliding tail boom may include a tapered portion. A tail boom sleeve may be fixed to a rear portion of the fixed tail boom. The tail boom sleeve may include a tapered portion that abuts the tapered portion of the through-bore when the sliding tail boom is in an extended position.

3 Claims, 6 Drawing Sheets

EXTENDABLE STABILIZER FOR PROJECTILE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to tube-launched projectiles and in particular to tube-launched projectiles that are statically stabilized.

Tube-launched projectiles may require adequate aerodynamic stability to damp out launch disturbances and maintain a low angle of attack throughout flight. Projectiles may be stabilized one of two ways, statically or gyroscopically.

A projectile may be considered statically stable if its aerodynamic center of pressure is aft of its center of gravity (CG). The distance between the aerodynamic center of pressure and the CG is known as the static stability margin, or SSM. As a rule of thumb, a projectile may be considered to possess adequate static stability if the SSM is at least 10% of the overall body length.

When designing a projectile, stabilizing surfaces (such as tail fins, flares) may be placed near the aft end of the projectile to produce an aerodynamic restoring moment. The stabilizing surfaces may be designed to produce enough lift so that the projectile has an adequate SSM. If the projectile is subjected to launch disturbances that cause it to rotate to an angle of attack, the restoring moment may realign the projectile axis with the velocity vector. Aerodynamic theory and empirical data may help select methods for producing the largest possible stabilizing moment at the desired flight conditions, while not causing undesirable side effects, such as high aerodynamic drag. The greatest benefits may be obtained by employing large lifting surfaces as far behind the CG as possible.

Most projectiles have practical limitations on the size (length or diameter) of tail stabilizers. Tube-launched projectiles, in particular, may be constrained in that no part of the body may be larger than the inside diameter of the tube. Some projectiles bodies, such as tank-fired kinetic energy projectiles, may be much smaller than the tube diameter. Such sub-caliber projectile bodies may be supported by (and guided along the tube with) a sabot, which discards upon exit from the tube. Once in flight, the fins are then a larger diameter than the diameter of the flight (projectile) body.

Some tube-launched projectiles may utilize folding fins or wrap-around fins to increase the aspect ratio of the fins (commonly used with tube-launched rockets and missiles). Such fins may be stowed within or near the body and may be deployed upon exit from the gun tube. The resultant super-caliber fins may add significantly to the projectile's stability. However, the cost, complexity and reduced reliability of these designs may be undesirable. These types of fins may increase the aerodynamic drag substantially, resulting in a loss of range. Most of these types of fins may have many moving parts. The moving parts must survive the harsh environment inside the gun tube (high pressures, temperatures and accelerations) and then deploy reliably upon exiting the tube.

To maximize the SSM, stabilizing surfaces may be located as far rearward as possible. Many times, however, the overall projectile length may be constrained due to packaging, storage or handling considerations. Thus, the stabilizer may not be moved far enough rearward to provide adequate stability.

When faced with this dilemma, the aerodynamic designer may resort to the use of folding fins to provide additional tail lift. While folding fins may provide the necessary SSM, such a solution may be undesirable for the reasons described above.

For a full-caliber projectile with a constrained length, a need exists for a static stabilizer that mitigates or eliminates the disadvantages associated with known static stabilizers, such as folded fins.

SUMMARY OF THE INVENTION

It is an object of the invention to provide a stabilizer for a projectile having a full-caliber body.

It is another object of the invention to provide a projectile stabilizer with a minimum of moving parts.

It is a further object of the invention to provide a method of stabilizing a tube-launched projectile.

One aspect of the invention is a projectile. The projectile may include a fixed tail boom having an outer diameter and a sliding tail boom having a through-bore with an inner diameter. The fixed tail boom may be at least partially disposed in the through-bore of the sliding tail boom. The sliding tail boom may be translatable with respect to the fixed tail boom. A collar may be fixed to a forward end of the sliding tail boom. The collar may support the sliding tail boom such that the outer diameter of the fixed tail boom does not contact the inner diameter of the sliding tail boom. The through-bore of the sliding tail boom may include a portion having an increased inner diameter. A transition from the inner diameter to the increased inner diameter may include a tapered portion.

A tail boom sleeve may be fixed to a rear portion of the fixed tail boom. The tail boom sleeve may include a guide that mates with a complementary guide on the sliding tail boom. The tail boom sleeve may include a portion of increasing outer diameter that abuts the tapered portion of the through-bore when the sliding tail boom is in an extended position. At least one fin may be attached to the sliding tail boom.

A forward portion of the fixed tail boom may include a plurality of gas openings and a forward portion of the sliding tail boom may include a plurality of gas openings. In a stowed position of the sliding tail boom, the plurality of gas openings of the sliding tail boom may be substantially aligned with the plurality of gas openings of the fixed tail boom.

A retainer may fix the sliding tail boom in a stowed position prior to launch of the projectile. The retainer may release the sliding tail boom from the stowed position prior to the projectile exiting a launch tube.

Another aspect of the invention is a stabilizer for a projectile. The projectile may have a fixed tail boom with an outer diameter. The stabilizer may include a sliding tail boom having a through-bore with an inner diameter. The fixed tail boom may be disposable in the through-bore of the sliding tail boom. The sliding tail boom may be translatable with respect to the fixed tail boom. A collar may be fixed to a forward end of the sliding tail boom. The collar may support the sliding tail boom to prevent contact of the outer diameter of the fixed tail boom with the inner diameter of the sliding tail boom.

The through-bore of the sliding tail boom may include a portion having an increased inner diameter. A transition from the inner diameter to the increased inner diameter may include a tapered portion.

A tail boom sleeve may be fixable to a rear portion of the fixed tail boom. The tail boom sleeve may include a guide that mates with a complementary guide on the sliding tail boom. The tail boom sleeve may include a portion of increasing outer diameter that abuts the tapered portion of the through-bore when the sliding tail boom is in an extended position.

A further aspect of the invention is a method that may include providing a projectile, placing the projectile in a launch tube, and igniting propellant in the launch tube. The method may include translating a sliding tail boom rearward with respect to a fixed tail boom before the projectile exits the launch tube.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A method for enhancing the performance of statically stabilized projectiles may include using fixed fins. The method may be used with, for example, a statically stabilized projectile having a geometry and mass that may preclude the use of known, conventional fixed fins.

The method may include using an extendable tail. The extendable tail may be a passive device that may contain, for example, only one moving part. The method may be used to enhance the performance of statically stabilized projectiles, including projectiles having a body diameter that is the full bore diameter.

Figure 1:
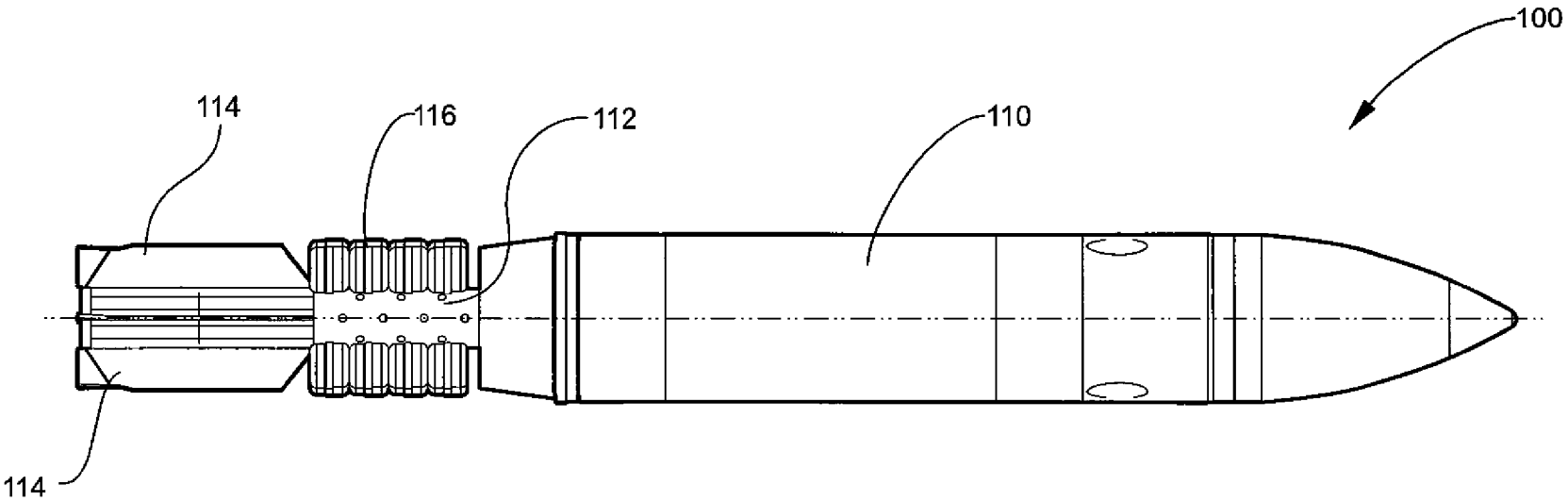
FIG. 1 PRIOR ART
FIG. 1 is side view of an embodiment of a conventional fin-stabilized projectile.

An embodiment of a conventional fin-stabilized, full-bore, tube launched projectile 100 is shown in FIG. 1. Projectile 100 may be fired from a smooth bore tube. Projectile 100 may include a body 110, a fixed boom 112, propellant 116, and a plurality of fins 114. Projectile 100 may not possess adequate static stability. Because the overall length of projectile 100 may be constrained, it may not be possible to achieve static stability by locating fins 114 farther rearward.

Figure 2:
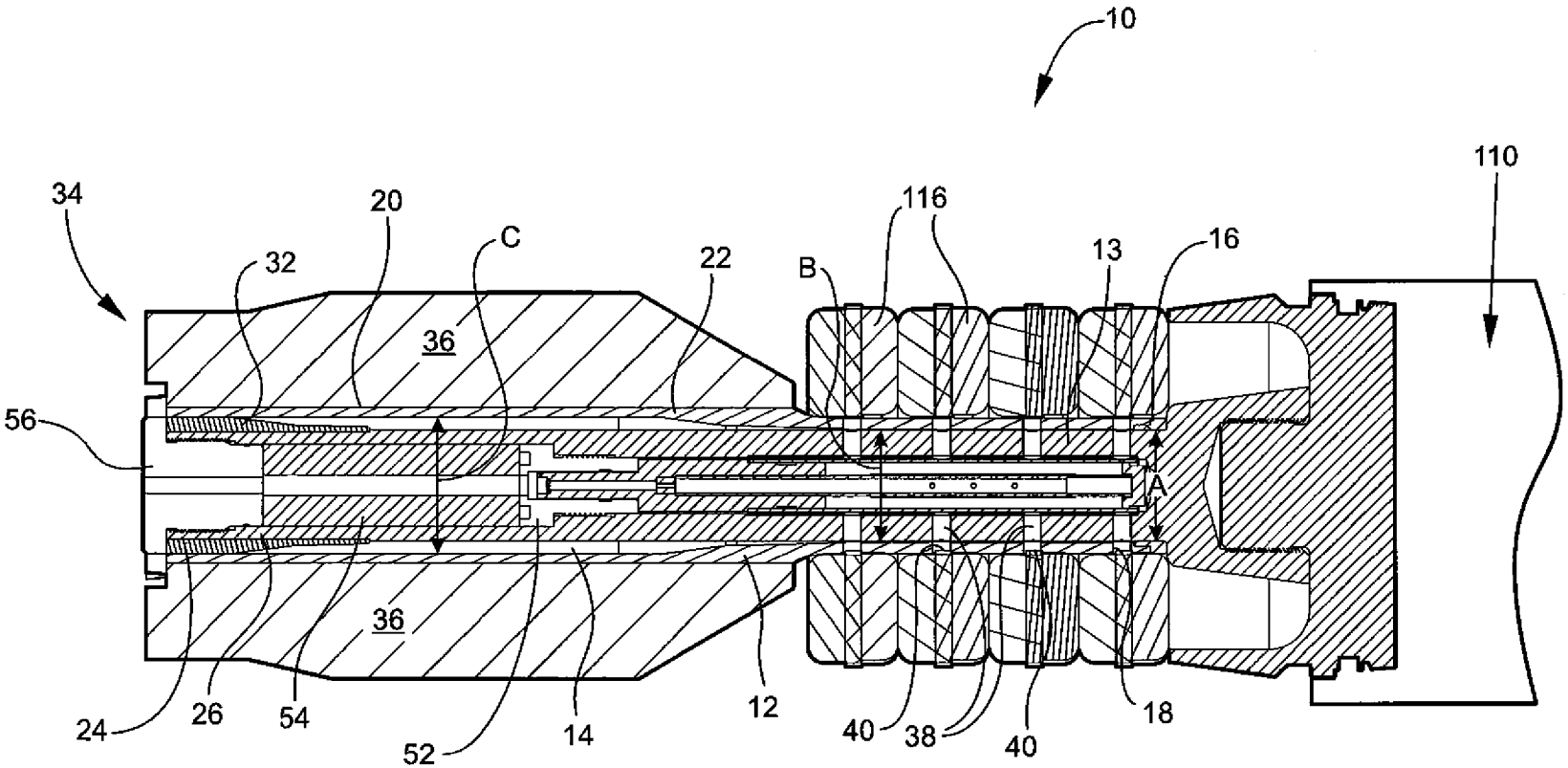
FIG. 2 is a partial, longitudinal, sectional view of an embodiment of a projectile with an extendable stabilizer in a stowed position.

FIG. 2 is a partial, longitudinal, sectional view of an embodiment of a projectile 10 with an extendable stabilizer in a stowed position. Projectile 10 may include body 110, a fixed tail boom 13, and propellant 116. Fixed tail boom 13 may have an outer diameter A. Projectile 10 may include a sliding tail boom 12 having a through-bore 14 with an inner diameter B (best seen in FIG. 3A). Fixed tail boom 13 may be at least partially disposed in through-bore 14 of sliding tail boom 12. Sliding tail boom 12 may be translatable with respect to fixed tail boom 13.

A collar 16 may be fixed to a forward end 18 of sliding tail boom 12. Collar 16 may support sliding tail boom 12 such that outer diameter A of fixed tail boom 13 does not contact inner diameter B of sliding tail boom 12.

Figure 3A:
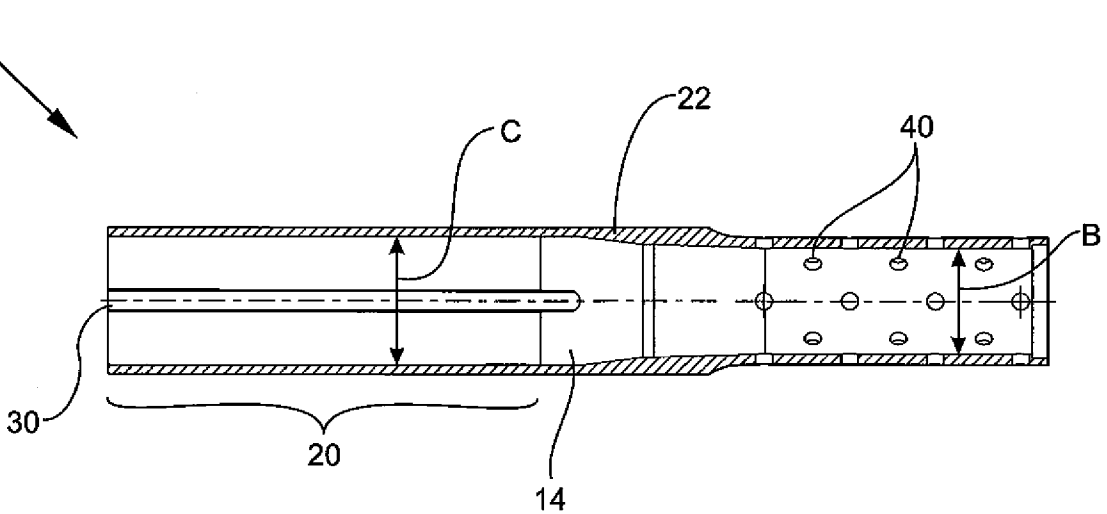
FIG. 3A is a sectional view along the line 3A-3A of FIG. 3.

Through-bore 14 of sliding tail boom 12 may include a portion 20 having an increased inner diameter C (best seen in FIG. 3A). A transition from inner diameter B to increased inner diameter C may include a tapered portion 22.

Figure 4A:
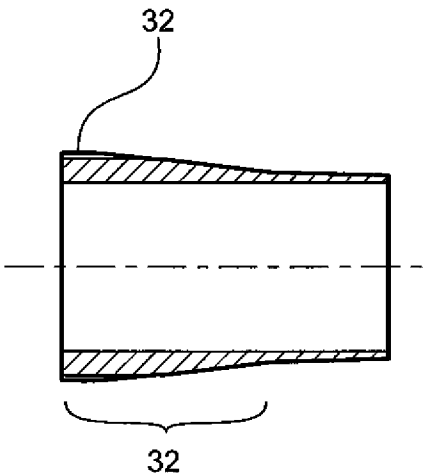
FIG. 4A is a sectional view along the line 4A-4A of FIG. 4.

A tail boom sleeve 24 (FIGS. 2, 4, and 4A) may be fixed to a rear portion 26 of fixed tail boom 13. Tail boom sleeve 24 may include a guide that mates with a complementary guide on sliding tail boom 12. In the embodiment shown in the Figures, the guide on tail boom sleeve 24 may be one or more slots 28 (FIGS. 4 and 4A) and the complementary guide on sliding tail boom 12 may be one or more projections 30 (FIG. 3A). Tail boom sleeve 24 may include a portion 32 of increasing outer diameter that abuts tapered portion 22 of through-bore 14 when sliding tail boom 12 is in an extended position.

Figure 5A:
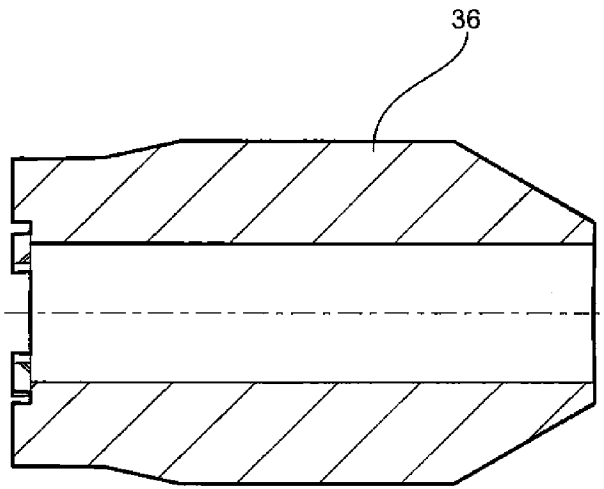
FIG. 5A is a sectional view along the line 5A-5A of FIG. 5.
Figure 5:
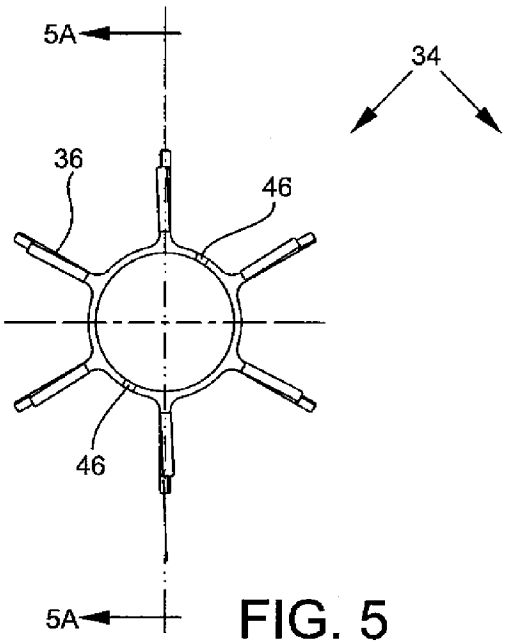
FIG. 5 is an end view of the fin assembly of FIG. 2.

A fin assembly 34 (FIGS. 1, 5, and 5A) having one or more fins 36 may be fixed to sliding tail boom 12.

A forward portion of fixed tail boom 13 may include a plurality of gas openings 38. A forward portion of sliding tail boom 12 may include a plurality of gas openings 40 (see also FIG. 3A). In the stowed position of sliding tail boom 12 shown in FIG. 2, gas openings 40 of sliding tail boom 12 may be substantially aligned with gas openings 38 of fixed tail boom 13.

Figure 3:
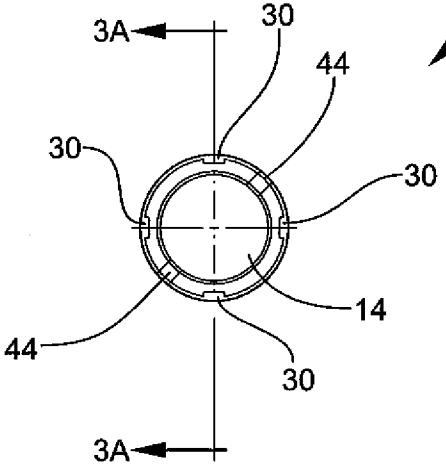
FIG. 3 is an end view of the sliding tail boom of FIG. 2.
Figure 4:
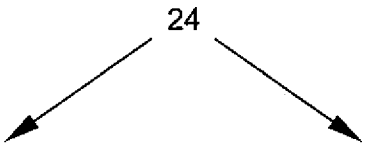
FIG. 4 is an end view of the tail boom sleeve of FIG. 2.
Figure 4:
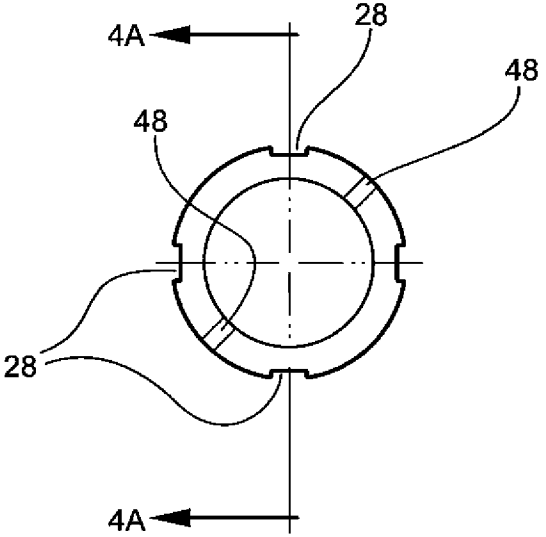
Figure 7:
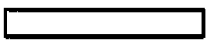
FIG. 7 is a side view of a shear pin.
Figure 6:
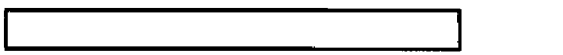
FIG. 6 PRIOR ART
FIG. 6 is a schematic view of a conventional gun launch tube.

A retainer may fix sliding tail boom 12 in the stowed position of FIG. 2, prior to launch of projectile 10. The retainer may release sliding tail boom 12 from the stowed position prior to the projectile 10 exiting a launch tube 50 (FIG. 6). The retainer may include at least one shear pin 42 (FIG. 7) Each shear pin 42 may be disposed in an opening 46 in fin assembly 34 (FIG. 5), an opening 44 in sliding tail boom 12 (FIG. 3), and an opening 48 in tail boom sleeve 24 (FIG. 4).

Projectile 10 may be loaded in tube 50 with sliding tail boom 12 in the stowed position of FIG. 2. Then the propellant 116 may be ignited and the aft end of projectile 10 may be immersed in high pressure gun gases. The high pressure gun gases may act upon the surface area of projectile 10, resulting in a force that may accelerate projectile 10 up gun tube 50.

Sliding tail boom 12 may be subject to the same high pressure gun gases in tube 50 as is projectile body 110. However, sliding tail boom 12 may have very little rearward facing surface area. The area of projectile body 110 acted upon by the gun gases may be approximately an order of magnitude larger than the area of sliding tail boom 12 acted upon by the gun gases, thereby creating a large differential force. The force accelerating sliding tail boom 12 in the forward direction may be quite small. The difference in forces acting on projectile body 110 and sliding tail boom 12 may cause shear pin or pins 42 to release.

Figure 8:
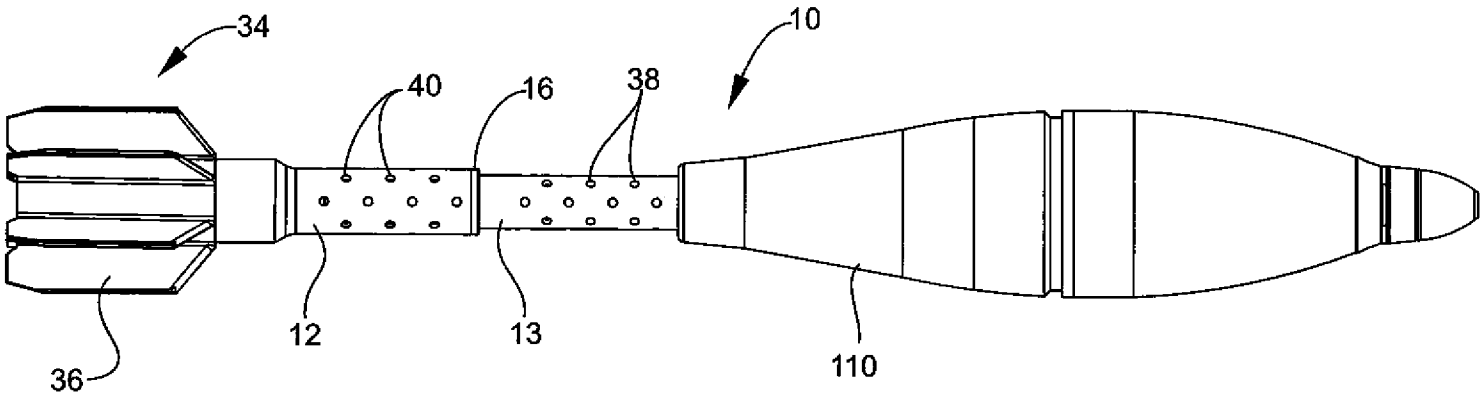
FIG. 8 is a side view of an embodiment of a projectile with an extendable stabilizer in an extended position.

When pin or pins 42 shear, sliding tail boom 12 may move rearward relative to projectile body 110. When sliding tail boom 12 is fully extended rearward relative to projectile body 110, it may lock in the fully extended position by mating tapered portion 22 of sliding tail boom 12 with tapered portion 32 of tail boom sleeve 24. Sliding tail boom 12 may remain in the fully extended position for the remainder of the flight of projectile 10. The rearward movement and locking of sliding tail boom 12 may occur while projectile 10 is inside of gun tube 50. FIG. 8 is a side view of projectile 10 with sliding tail boom 12 in the fully extended position.

An alternative to shear pins 42 may be a retainer made of an energetic material or other material that may be consumed by the gun gases, thereby allowing sliding tail boom 12 to slide rearward.

The embodiment of the invention shown in the Figures is described in conjunction with a mortar projectile. However, the invention may be applied to any statically stabilized projectile.

Fixed boom 13 may be an integral part of projectile body 110 or it may be permanently attached to the aft end of projectile body 110. Because cylindrical outer diameter A of fixed boom 13 may be smaller than inside diameter B of sliding tail boom 12, there may be no physical contact between fixed boom 13 and sliding tail boom 12. Collar 16 may support and guide sliding tail boom 12 as it slides rearward along fixed boom 13. Projections 30 on sliding tail boom 12 and mating slots 28 in tail boom sleeve 24 may guide and align sliding tail boom 12 as it slides rearward.

Projections 30 and mating slots 28 may also prevent sliding tail boom 12 from rotating relative to fixed boom 13. When projectile 10 is in free-flight outside of launch tube 50, the roll torque generated by fins 36 may be transmitted to the projectile body 110 so that the components of projectile 10 spin together. Thus, it may be important to prevent sliding tail boom 12 from rotating relative to fixed boom 13.

When sliding tail boom 12 is fully extended, it may lock in the fully extended position by mating of tapered portion 22 of sliding tail boom 12 with tapered portion 32 of tail boom sleeve 24. Tapered portion 32 of tail boom sleeve 24 may provide a stop and lock for sliding tail boom 12. After projectile 10 is launched, there may be minimal forces that act to push sliding tail boom 12 forward on fixed boom 13. Thus, the locking taper may be sufficient to prevent any such movement. If necessary, an additional locking device, such as a spring-loaded detent (not shown) may be used to further lock sliding tail boom 12 in its extended position.

For certain applications, such as mortar projectiles, fixed boom 13 may include a conventional ignition cartridge 52, sleeve 54, and plug 56 (FIG. 2).

Wind tunnel tests were performed at subsonic Mach numbers on a mortar projectile with sliding tail boom 12 in both stowed and extended positions. The test results indicate that the projectile with sliding boom tail 12 in the extended position achieves greater static stability, with no increase in aerodynamic drag.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile, comprising:

a fixed tail boom having an outer diameter;

a sliding tail boom having a through-bore with an inner diameter, and at least one fin attached to said sliding tail boom, and, said fixed tail boom being at least partially disposed in the through-bore of said sliding tail boom, and said sliding tail boom being translatable with respect to said fixed tail boom;

a collar fixed to a forward end of the sliding tail boom, the collar supporting the sliding tail boom such that the outer diameter of the fixed tail boom does not contact the inner diameter of the sliding tail boom;

the through-bore of the sliding tail boom including a portion having an increased inner diameter wherein a transition from the inner diameter to the increased inner diameter includes a tapered portion; and a tail boom sleeve fixed to a rear portion of the fixed tail boom, the tail boom sleeve including a guide that mates with a complementary guide on the sliding tail boom, the tail boom sleeve further including a portion of increasing outer diameter that abuts the tapered portion of the through-bore when the sliding tail boom is in an extended position, and wherein a forward portion of the fixed tail boom includes a plurality of gas openings and a forward portion of the sliding tail boom includes a plurality of gas openings.

2. The projectile of claim 1, wherein, in a stowed position of the sliding tail boom, the plurality of gas openings of the sliding tail boom are substantially aligned with the plurality of gas openings of the fixed tail boom.

3. A stabilizer for a projectile having a fixed tail boom with an outer diameter, comprising:

a sliding tail boom having a through-bore with an inner diameter and at least one fin attached to said sliding tail boom, and wherein a forward portion of said sliding tail boom includes a plurality of gas openings, said fixed tail boom being disposable in the through-bore of said sliding tail boom, and said sliding tail boom being translatable with respect to said fixed tail boom:

a collar fixed to a forward end of the sliding tail boom, the collar supporting the sliding tail boom to prevent contact of the outer diameter of the fixed tail boom with the inner diameter of the sliding tail boom;

the through-bore of the sliding tail boom including a portion having an increased inner diameter wherein a transition from the inner diameter to the increased inner diameter includes a tapered portion; and a tail boom sleeve fixable to a rear portion of the fixed tail boom, the tail boom sleeve including a guide that mates with a complementary guide on the sliding tail boom, the tail boom sleeve further including a portion of increasing outer diameter that abuts the tapered portion of the through-bore when the sliding tail boom is in an extended position and, wherein, in a stowed position of the sliding tail boom, the plurality of gas openings of the sliding tail boom are substantially aligned with a plurality of gas openings of the fixed tail boom.

* * * * *